United States Patent [19]

Monreal

[11] Patent Number: 4,623,158

[45] Date of Patent: Nov. 18, 1986

[54] SPORTING KNEE BOOT FOR SLIDING, SKATING AND SKIING

[76] Inventor: F. Javier Monreal, 4242 Barker Hill Rd., Jamesville, N.Y. 13078

[21] Appl. No.: 774,010

[22] Filed: Sep. 9, 1985

Related U.S. Application Data

[63] Continuation-in-part of Ser. No. 594,367, Mar. 29, 1984, abandoned.

[51] Int. Cl.[4] ..... A63C 1/02; A63C 5/00

[52] U.S. Cl. ..... 280/11.12; 280/11.25; 280/618; 280/12 R

[58] Field of Search ..... 280/11.12, 610, 11.18, 280/11.19, 11.25, 11.27, 618, 809, 12 R, 32.5, 87.02 R; 2/24; 441/65

[56] References Cited

U.S. PATENT DOCUMENTS

| | | | |
|---|---|---|---|
| 1,138,973 | 5/1915 | Prince | 2/24 |
| 1,264,767 | 4/1918 | Boynton et al. | 2/24 |
| 1,293,240 | 2/1919 | Summers | 2/24 |
| 1,486,308 | 3/1924 | Shook | 2/24 |
| 1,547,166 | 7/1925 | Davidson | 2/24 |
| 1,668,623 | 5/1928 | Avril | 280/87.02 R |
| 2,318,059 | 5/1943 | Cooper | 280/32.6 X |
| 2,448,427 | 8/1948 | Gordon | 280/32.5 |
| 2,480,406 | 8/1949 | Forney | 280/12.1 |
| 2,484,494 | 10/1949 | Ferguson | 2/24 |
| 3,025,526 | 3/1962 | Ramon | 2/24 |
| 3,084,458 | 4/1963 | Ramon | 2/24 X |
| 3,112,812 | 12/1963 | Ramon | 2/24 X |
| 3,689,092 | 9/1972 | Lake | 280/809 X |
| 3,908,198 | 9/1975 | Brock | 2/24 |
| 4,028,761 | 6/1977 | Taylor | 280/18 X |
| 4,333,181 | 6/1982 | Corriero | 2/24 |
| 4,353,573 | 10/1982 | Morgan | 280/12 R X |
| 4,413,832 | 11/1983 | Pendleton | 280/12 R |

FOREIGN PATENT DOCUMENTS 843232 7/1949 Fed. Rep. of Germany ..... 2/24

*Primary Examiner*—John J. Love
*Assistant Examiner*—Michael Mar

[57] ABSTRACT

A paired sporting device that consists of a knee contoured shell, here called knee boot, of light weight sheeting material, that engulfs the user's kneeling knee, covering the weight bearing area of the knee, the sides of the knee joint, medially and laterally and the upper ⅓ to ½ of the sides of the calf and the sides of the lower ⅓ to ½ of the thigh, being opened in the rear for entry and release, and provided with fastening straps to bridge over the user's lower thigh and upper calf. The device, preferably of firm and tear-resistant plastic is offered in two basically different versions: One where the described shell or knee boot is a one piece, continuous device, plus its fastening straps; the other, where the section of boot that holds medially and laterally the lower part of the thigh, bridged together in front of the user's thigh, is jointed or articulated upon the lower section of the said knee boot that bears the weight of the kneeling person, via a medial and a lateral flat joints. The one piece, non articulated knee boot version is fully open in front of the user's thigh from just above the upper lip of the user's patella bone, and its sections that cover the sides of the lower thigh are simply strapped together via an elastic strap that allows some knee flexion/extension.

Either the one piece knee boot or the two piece, articulated version, are provided optionally, at the undersurface of the weight bearing area, with an ice-skate runner, or with a flat sole to sled or ski, or with a ski-boot specially shaped sole, or with a single or a double pair of roller skating wheels, for the different corresponding practical applications of the knee boot.

3 Claims, 12 Drawing Figures

FIG. 1
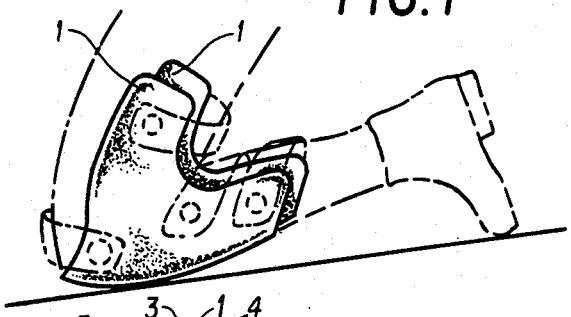
FIG. 2
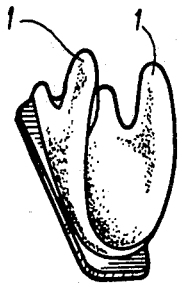
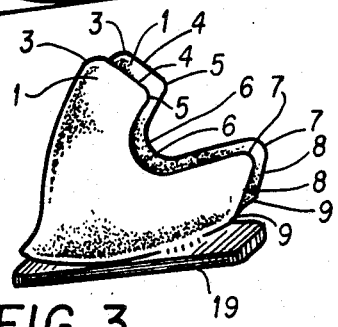
FIG. 3
FIG. 4
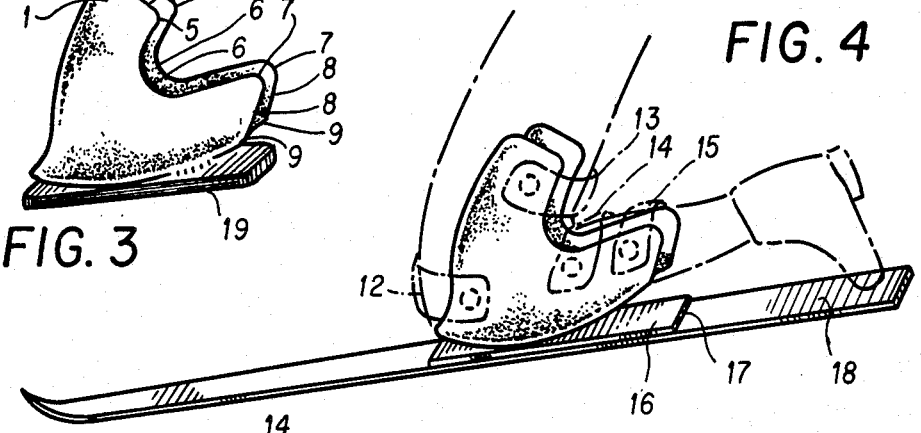
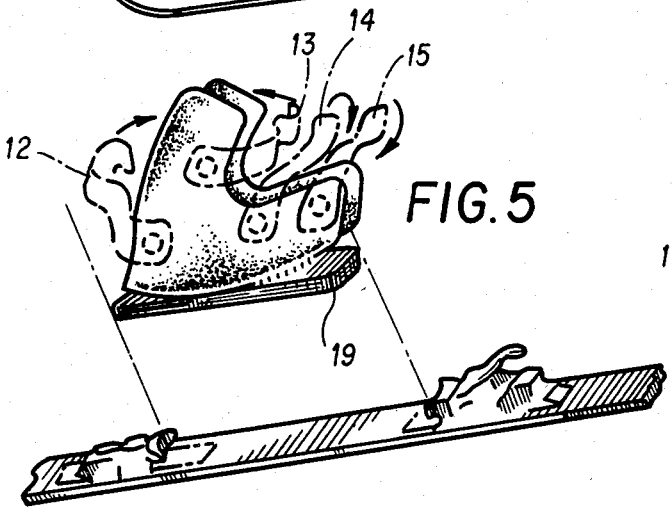
FIG. 5
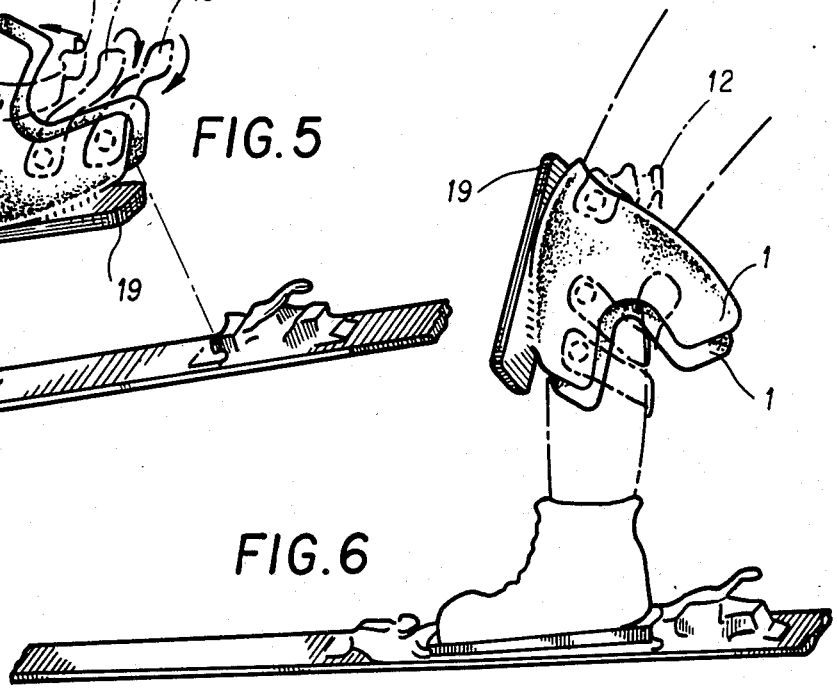
FIG. 6

SPORTING KNEE BOOT FOR SLIDING, SKATING AND SKIING

BACKGROUND INFORMATION

This is a continuation-in-part of Ser. No. 594,367, filed Mar. 29, 1984, now abandoned.

This invention of a sporting "knee-boot" unifies into a single and practical idea the concept of a recreational sporting device for the purpose of sliding on slippery surfaces in the kneeling position. The purpose of the device is to offer a knee-contoured shell to protect the knee in the kneeling position, bearing weight on it; to offer, secondly, firm lateral support of the sides of the knee joint and lower sides of the thigh (thus protecting the joint not only from impacts but also from excessive torsion, plus offering the best possible control and torque); its purpose, thirdly, is to allow full knee flexion and extension (thus permitting to use the device in the kneeling position and also to walk upright with the device still attached to the user's knees); fourthly the knee-boot proposed herewith can be used in its simplest form as a means of sliding on hard and slippery surfaces without a particular contact surface, and it is further provided with a pair of roller wheels (for roller skating), or with a standard ski boot sole that permits its fastening onto an ordinary snow ski.

Revision of the existing art work reveals that none of the thought of or of existing or of patented devices aimed at sliding in the kneeling position cover all those major qualities. The reviewed material include:

R. C. Avril's "Coaster" of 5/8/1928 U.S. Pat. No. 1,668,623

W. A. Boynton & G. A. Terrell's "Cotton Picker's Knee Pad" of 4/30/1918, U.S. Pat. No. 1,264,767

W. L. Brock's "Seam Skate for Carpets" of 9/30/75, U.S. Pat. No. 3,908,198

F. T. Cooper's "Kneeling Dolly" of 5/4/43, U.S. Pat. No. 2,318,059

J. Corriero's "Protective Structures for joints" of 6/8/82, U.S. Pat. No. 4,333,181.

H. K. Davidson's "Knee Pad" of 7/28/1925 U.S. Pat. No. 1,547,166

A. Deppe's "Securing Knee Protector" of 7/7/52 East German Pat. No. 843,232

R. O. Ferguson's "Knee Pad" of 10/11/1949, U.S. Pat. No. 2,484,494

J. C. Forney's "Knee Sled" of 8/30/49, U.S. Pat. No. 2,480,406

B. Gordon's "Knee Pad Dolly" of 8/31/1948 U.S. Pat. No. 2,448,427

R. P. Jarrell's "Knee Protector" of 3/23/76, U.S. Pat. No. 3,945,047

R. Klima's "Knee Ski" of May 11, 1953, Austrian Pat. No. 174,845

G. F. Lake's "Snow and Water Skimming Device" of 9/5/72, U.S. Pat. No. 3,689,092

D. F. Morgan's "Knee Engaging Ski" of 10/12/82, U.S. Pat. No. 4,353,573

J. E. Pendleton's "Body Sled" of 11/8/83, U.S. Pat. No. 4,413,832

P. Prince's "Knee Rest for Cotton Pickers" of 5/11/15, U.S. Pat. No. 1,138,973

G. Ramon's "Knee Rest" of 12/3/63, U.S. Pat. No. 3,112,812

G. Ramon's "Kneeling Devices" of 3/20/62, U.S. Pat. No. 3,025,526

P. J. Summers' "Knee Pad" of 2/4/19, U.S. Pat. No. 1,293,240

T. H. Shook's "Knee Pad" of 3/11/24, U.S. Pat. No. 1,486,308

J. Taylor's "Multipurpose Slide" of 6/14/77, U.S. Pat. No. 4,028,761

J. M. Wallace's "Ski" of 9/19/40, U.S. Pat. No. 2,242,156

All those patents, as well as prior and existing devices suitable for knee support in the kneeling position, have been reviewed, and none have been found to allow the user, in combination, to kneel or to stand, to hold firmly to the upper calf and lower thigh and to simultaneously be compatible with existing children (i.e. toy-like) or adult and competition skis or skates (by providing the device with an ice blade or a pair of wheels).

BRIEF DESCRIPTION OF THE INVENTION

This sporting and recreational device, intended to allow the kneeling user a good support and protection of the knee and also a good control and torque, consists of a light weight knee-contoured shell of sheeting plastic material such as polypropylene or polyethylene that in one piece engulfs the weight-bearing portion of the kneeling knee, the sides of the knee joint (with the femoral condyles) and the anatomical front and sides of the upper $\frac{1}{3}$ to $\frac{1}{2}$ of the lower leg. Protection of the knee joint is further asured by two possible variations in the basic device: the simplest form extends the lateral sides of the device well above the femoral condyles into the sides of the lower $\frac{1}{3}$ to $\frac{1}{2}$ of the thigh in a continuous, non articulated fashion. In this form, there is full and rigid protection of the knee area and excellent torque and even some mobility of flexion/extension of the knee, as permitted by the give of the elastic securing straps, but for the user to get up on his/her feet, since the thigh extensions or wings are not articulated, he/she has to unstrap the said thigh extension, still able to keep the device in place; the second form or variation to the basic knee boot has similar thigh extensions to offer equal protection, torque and control but these extensions (one medial and one lateral) are articulated with the main lower portion of the knee boot, thus allowing instantly the kneeling or the erect position without unstrapping any parts.

Under the weight-bearing area of this knee boot one can have just its bare shell or boot for sliding on ice (as a children toy), or one can provide it with a runner or blade (for ice skating), or with a pair of free rolling wheels (for roller skating, primarily downhill and not on level ground), or with a flat, attachment sole to be permanently fastened to a ski, or with a specially shaped and thickened ski-boot sole so the device can be used with ordinary skis and ski bindings.

BRIEF DESCRIPTION OF THE FIGURES

FIG. 1 is a left lateral view of the instant "non articulated" Knee Boot invention with four securing straps (dotted lines) and with the user's leg in the kneeling position (dashed lines). No attachments are shown.

FIG. 2 is a right rearward-downward view of the instant, non articulated Knee Boot, shown strapless but with a thickened and shaped "ski boot sole".

FIG. 3 is a left lateral view of the instant invention in its nonarticulated form, shown strapless and with the "ski boot sole".

FIG. 4 is a left lateral view of the instant non articulated invention with four adjustable straps and a flat "sole" that is fastened to a ski.

FIG. 5 is a left lateral view of the instant non articualted invention provided, as in FIG. 2, with a shaped and thicked "ski boot sole" to be positioned (and also easily unlocked) onto an ordinary ski with ordinary bindings. The adjustable straps are shown loose.

FIG. 6 is a left lateral view of the instant invention, as in FIG. 5, but here with the front strap loosened as the person is in the standing position (leg marked in dashed lines) and the Knee Boot is still secured to the person's knee while walking, with ordinary ski boots, on ordinary skis.

DETAILED DESCRIPTION OF THE INVENTION

Figure 7:
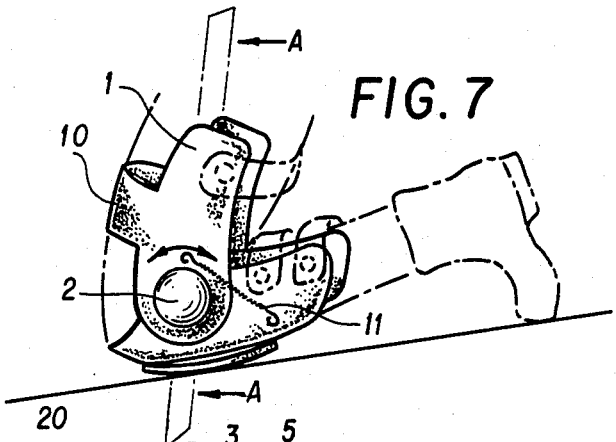
FIG. 7 is a left lateral view of the instant invention in its articulated or "pivoted" version, with a "flexing spring" mechanism and with a skate "runner" in its weight-bearing bottom.

Referring to the invention as a unitarian idea, it consists of a knee-contoured light weight shell that in a continuous and smooth fashion engulfs the weight bearing area of the kneeling knee, the sides of the knee joint and femoral condyles and the upper or proximal ½ to ⅓ of the calf in its anatomical front and on its sides, being open in the rear of the knee and calf. The sides of the lower ½ to ⅓ of the thigh are also embraced by thigh wings (marked in FIGS. 1, 2, etc. by the numerals 1 and 1). These thigh wings 1 and 1 are either directly part of the main shell or boot as a continuous and uninterrupted part of it as in FIGS. 1 through 6, or, as in FIGS. 7 through 12 are articulated with the main part of the knee boot or pivoted upon it via a flat metal joint (one medial and one lateral) marked by the numeral 2 and that is seen from the left side on FIGS. 7, 9, 10 and 11 and in cross section in FIGS. 8 and 12.

The contour of the said knee boot is to have rounded and smooth edges for safety if the device is used with little padding. Its material is of light weight sheeting plastic such as polyethylene or polypropylene made into shape by a vacuum or an injection process, the qualities and thickness and trim of which may vary with the expense intended or with whether the device is intended for hard competition or as a toy. The whole contour and edges of the "one piece" knee boot (FIGS. 1 through 6) or of the articulated "two piece knee boot (FIGS. 7 through 12), placed in position, follows the following approximate path (of course being the medial and the lateral contours around each leg totally symmetrical): Starting at the anterior-most point of the anatomical patella bone (in the kneeling position), the outline of the knee boot continues upward and to the sides of the thigh in an approximate 6O° inclination, then vertically upward for 2 to 3 inches and again slightly tilted again 6O° upon the horizontal till it reaches the upper-most point (marked by the numeral 3 in FIG. 3); from the point 3, the outline makes a straight corner down and rearward with a straight segment 3 to 4 inches long on the medial and latral aspect of the thigh, segment marked in FIG. 3 by the numerals 4 and 4, to point marked by the numeral 5 and 5 in the same FIG. 3; from point 5, the outline of the knee boot turns down in a course approximately parallel to the described portion of the anterior edge prior to point 3; in this down turn (by the rear-most part of each side of the thigh) the outline of the knee boot makes a complete semicircle, marked in FIG. 3 by the numerals 6 and 6; at the rear-most portion of this semicircle, the outline follows, semi-horizontally the upper-most part of each side of the calf in a length of 4 to 5 inches till point 7 (marked as 7 and 7, respectively, in FIG. 3, for each side of the calf; from point 7, the outline makes a straight turn down to a semi-vertical segment, on each side of the mid-calf, segment marked by the numerals 8 and 8, to point 9 (also paired and symmetrical points as all the previous points and segments of the outer contour); from point 9 of FIG. 3 the outline on each side of the calf turns forward and to meet each other under the shin of the leg at point 10 only seen in the cross section FIGS. 8 and 12. This outline of the outer contour fits both the one-piece knee boot and the two piece articulated or pivoted version. However, there are some peculiarities to the contour of the pivoted section as described immediately below:

The pivoted two-piece knee boot has the same general outer contour just described, but the vertical arms or thigh wings (numerals 1 and 1) are a separate element pivoted upon the lower section as in FIGS. 7 through 12 via a flat metal joint (one medial and one lateral, marked by the numerals 2 and 2), metal joint already widely in use in the ski boot industry. The complete ouline of these vertical arms sweeps down from the two top-most points (3 and 5 laterally and 3 and 5 medially, as marked also in FIG. 9), so the anterior and the posterior edges of such arms are approximately parallel to each other and the arms 3 to 5 inches wide, slightly wider at the bottom than at the top, and with a rounded bottom contour circling the metal joint 2 (on each medial and lateral side of the knee). The existance of these separate and articulated vertical arms means, of course that the lower portion of the main knee boot, from the front end and the sides of the patella bone simply circles in its outer contour, the upper part of the flat metal joint to proceed rearward in a semihorizontal course towards point 7 (paired, medially and laterally and identified as 7 and 7 in FIGS. 8 and 9). The vertical arms of the articulated two piece boot are attached to the main section via the mentioned joints 2 and 2, and placed in immediate outer contact with it, so the lower portion of the said arms is on the otside of it.

Additionally the said vertical pivoted arms of FIGS. 7 though 12 are bridged with each other by a continuous band of the same light weight plastic shheting material of the rest of the knee boot, bridging the anterior edges of the said vertical arms at mid shaft (bridge or band identified in FIGS. 7, 9, 10 and 11 by the numeral 10). This wide and horizontal band, 2 to 4 inches wide, along with the two vertical arms form a single upper piece of the two piece knee boot. This said upper piece as the main stabilizing factor of the knee boot for lateral torque and control in speed sliding and in turns, and at the same time it offers superb protection of the knee joint (by embracing the lower thigh), not offered by other existing or patented knee pads or knee protecting devices. By its being pivoted, it allows knee flexion and extension.

An optional spring mechanism to maintain the device "flexed", and thus better secured against the user's knee (and for packaging) is suggested. This spring mechanism may be built inside the metal joints to provide them with a tendency to a clock-wise rotation (when seen, as in the figures, from the left), or it may be outside, marked with the numeral 11 in FIG. 7 and bridging between the lower portion of the vertical arm(s) and the rear portion of the main section of the knee boot.

Four securing or fastening straps marked with the numerals 12, 13, 14 and 15 in FIGS. 4 and 5 hold the leg firmly in position. They may be variably firm and elastic and glued and/or rivetted in one end (as shown in FIG. 5) to one free edge of the knee boot, and fastenble over the user's leg to the paired free edge of the knee boot by way of a snap, hook, buckle or or the Velcro stripping ®. Strap 12, in particular, going over the front of the thigh, is positioned relatively low in the vertical arms so as to allow some knee flexion/extension in the one piece non pivoted knee boot. This strap 12 is unnecessary in the two piece pivoted knee boot for obvious reasons, since in the said two piece pivoted version the upper arms already bridge with each other via the wide band 10.

Padding in the inner aspect of the knee boot, articualted or not, is variable and it may built in or left out so the person wares a separate elastic and tightly fit knee cuff (already widely available), or left to the person's multilayered winter clothing. The padding will also depend on the price intended and whether the device is for competition or intended as a relatively cheap children's toy.

MODIFICATIONS TO THE KNEE BOOT'S WEIGHT BEARING SECTION

The thus described Knee Boot in its two versions (articulated and non-articulated) can be used for a number of sporting activities where one intends to slide down in a low-friction/slippery surface. Depending on whether the device is used as a toy or for hard and speedy competition, and depending on the type of surface where it might be used one introduces the following modifications or options to the weight-bearing area of the Knee Boot:

(1) One can, first of all, leave its naked, rounded, knee-contoured bottom as is depicted in FIG. 1, specially when it is manufactured of a single piece, non articulated plastic, to use as a children's toy to slide down their icy driveways in the winter. Such a cheap Knee Boot toy can even be distributed and sold without the optional four straps, as the embracing shell, specially with its side thigh wings 1 and 1 can, by itself, hold well to the child's knee and also release easily in the case of a tumble. Though not depicted in the figures that contain the articulated version, FIGS. 7 through 12, this articulated version can, of course, be also supplied without special attachemnts in its weight-bearing area.

(2) One can also attach to its weight bearing area a flat sole. The most simple flat sole, identified in FIG. 4 by the numeral 16, can simply be a squared or rectangular firm sheet of plastic (such as 3/16" or ¼" polypropylene) that is heat-bonded and/or rivetted to the bottom of the weight-bearing area of the non-articulated or of the articulated described Knee Boot. This sole, with or without longitudinal, reinforcing ribs and grooves (numeral 17 in FIG. 4) can be used as a plate to rivet and/or bolt a sled or ski (numeral 18 of FIG. 4) to the described Knee Boot. Alternatively, one can use the thus described one piece or two piece Knee Boot with this flat sole attachment as a means to slide on ice or snow (specially if the snow is not deep), by itself and without further bolting it or securing it onto a longer board such as a ski.

(3) One can also attach to its weight-bearing bottom a specially shaped and thickened sole, numeral 19, sole that has the exact shape and proportions of the user's ordinary ski boot sole (currently in use being thinner and wider in the front and thicker and narrower in the back). Of course either the one piece, non articulated Knee Boot, or the two piece articulated model can have this "ski boot sole", heat-bonded and/or rivetted or bolted to the weight bearing bottom. The enormous advantage of this attachment being that it allows to use the same pair of skis either afoot or kneeling. Additionally, one can walk or slide erect on one's skis to the ski lift or to the skiing start point while keeping the knee boot(s) on one's knees (without having to carry the Knee Boots and the ski poles in one's hands) and then at the start point one can decide on whether to ski down standing on one's feet or on one's knees.

Figure 8:
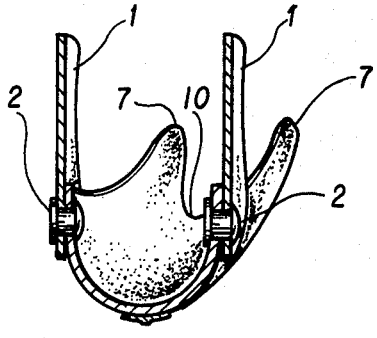
FIG. 8 is a cross section view of the rear half of FIG. 7 as disected by the plane A—A.
Figure 9:
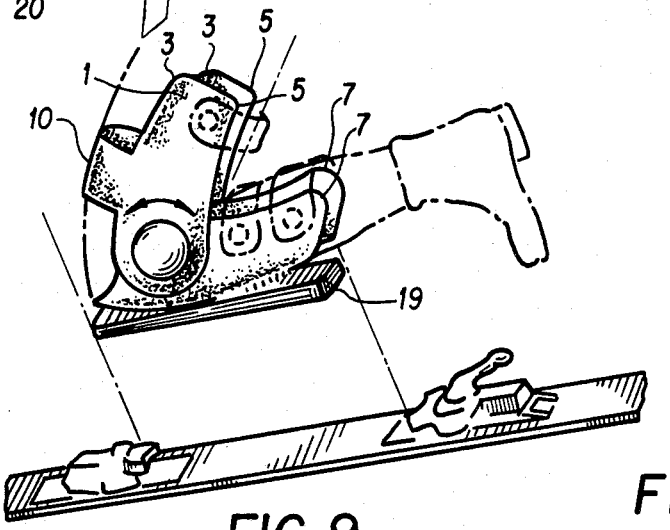
FIG. 9 is a left lateral view of the instant invention in its articulated or pivoted version, provided with a "ski boot sole" in its weight bearing area so it can be movably positioned onto odinary skis by ordinary bindings.
Figure 10:
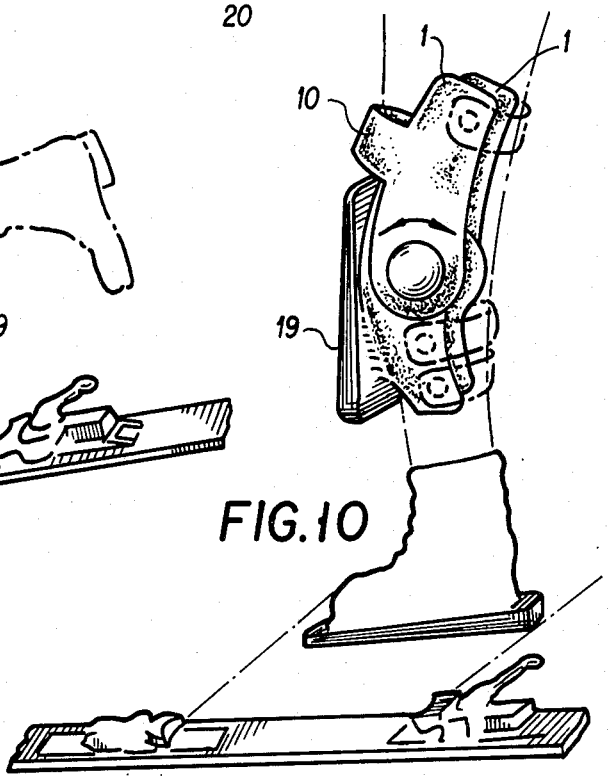
FIG. 10 is a left lateral view of the instant invention in its articulated or "pivoted" version as in FIG. 9, but here placed in position with the person's leg straight and walking upright with ordinary ski boots on the same ordinary skis.

(4) One can also attach to its weight bearing area, as in FIGS. 7 and 8, an ice skate runner, numeral 20, or ice skate blade. This blade, of variable height and width can be bolted or rivetted to the bottom of the Knee Boot as an ordinary ice skate blade to its shoe sole and as shown in cross section in FIG. 8. It would seem obvious that on one's knees that one cannot propel oneself well on ice to ice-skate on level ground, but to slide down a slanted icy driveway or an Ad Hoc prepared ice chute, this combination of Knee Boot and Ice Runner or Ice Blade would be a superb form of sledding at even high speeds, kneeling and all curled over onto one's thighs like a ball. In this high speed skating or sledding it would be advisable to have one one's shoes some sort of hardened or metal tip, but this is not part of this invention.

Figure 11:
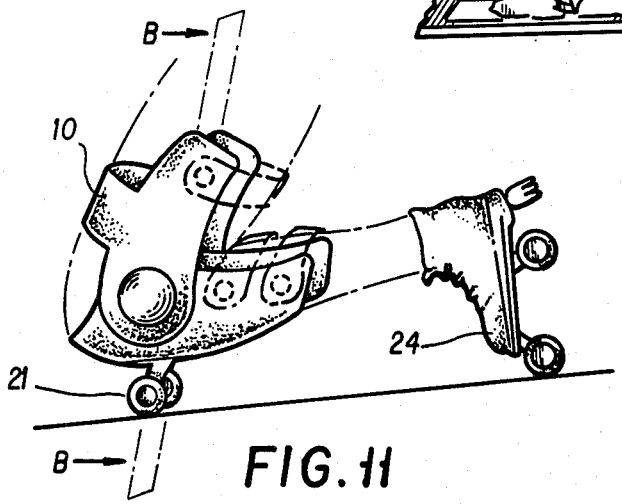
FIG. 11 is a left lateral view of the instant invention in its articulated or pivoted fashion, here provided, in its weight bearing bottom, with a pair of free rolling wheels for roller-skating (here with specially modified roller skates in the person's foot for tip-of-the-foot support).
Figure 12:
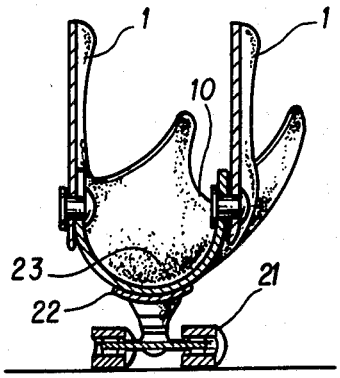
FIG. 12 is a cross section view of the rear half of the instant invention as shown in FIG. 11 for roller skating, section made by the disecting plane B—B.

(5) Finally, one can also attach to the weight-bearing area of the Knee Boot a pair of roller wheels, numeral 21, as shown in FIGS. 11 and 12. This pair of roller skating wheels can be of different material and qualities, plastic, wood or metal, and it can be attached via a combination of axis/stem/fastening T plate, numeral 22, to the bottom of the weightbearing area of the described Knee Boot. The fastening plate can be secured to the Knee Boot, as the hardware of roller skates to the shoe sole via bolts or rivets, 23. The particular existing combinations of rubber pads and washers in the wheels stem, or an all-metal connector or the particular "tilt" of the stem on the resting ground is not part of this invention and thus can vary. As with the modification #4 described above for ice skating/sledding, here, in roller skating, one also needs a slanted pavement since one cannot propel oneself one one's knees on level ground.

It is also obvious that to roller skate on one's knees with the described Knee Boot that one also needs to ware one one's feet special roller skates, numeral 24 where the front wheel pair is "ahead of the shoe tip" so wheel contact with the ground occurs at the knee and at the foot level. Nevertheless, this modified foot roller skate is not part of this invention and it will not be described here further. Because one may want to ware at the same time foot roller skates and Knee Boot Roller skates, and thus one may want to stand and to kneel with both or with one knee on the ground, or to do tricks and pirouettes, it is desirable that the described Knee Boot with a pair of roller wheels be of the two piece or articulated type to allow free flexion/extension of the knee without fastening/unfastening straps. A double pair of wheels per knee boot (not drawn), is also an option.

What I now claim is:

1. A sporting knee boot made of semi-rigid plastic material and having a contoured shell adapted to engulf the user's knee and part of the user's thigh and calf, comprising a first section having a curved bottom portion and upwardly extending side portions, said first section being adapted to receive and support the knee and the upper one third to one half of the user's calf wherein the front of the user's thigh extends through a forward opening of said first section and the user's lower calf extends through a rearward opening of said first section, a second section having a pair of side portions extending from the user's knee to a distance of one third to one half of the height of the user's thigh, said side portions of said second section overlapping said side portions of said first section and being pivotally connected thereto by hinge means, said second section having a curved band for engaging the front of the user's thigh, the ends of said band being connected to the front edges of said side portions of said second section, a spring connected between said first section and said second section wherein said second section is biased for rotational movement in the direction of the user's calf, an adjustable strap secured to the side portions of said second section for engaging the rear of the user's thigh, at least one adjustable strap secured to the side portions of said first section for engaging the rear of the user's calf, and a sole plate secured to the bottom of said first section, said sole plate having a rectangular shape with rounded corners and tapering in thickness from the its rear section to its front section, wherein said sole plate is adapted to be secured to a ski by ski bindings.

2. A sporting knee boot made of semi-rigid plastic material and having a contoured shell adapted to engulf the user's knee and part of the user's thigh and calf, comprising a first section having a curved bottom portion and upwardly extending side portions, said first section being adapted to receive and support the knee and the upper one third to one half of the user's calf wherein the front of the user's thigh extends through a forward opening of said first section and the user's lower calf extends through a rearward opening of said first section, a second section having a pair of side portions extending from the user's knee to a distance of one third to one half the height of the user's thigh, said side portions of said second section overlapping said side portions of said first section and being pivotally connected thereto by hinge means, said second section having a curved band for engaging the front of the user's thigh, the ends of said band being connected to the front edges of said side portions of said second section, a spring connected between said first section and said second section wherein said second section is biased for rotational movement in the direction of the user's calf, an adjustable strap secured to the side portions of said second section for engaging the rear of the user's thigh, at least one adjustable strap secured to the side portions of said first section for engaging the rear of the user's calf, and runner means having a longitudinally extending body with a cross-section in the shape of a T, the horizontal portion of the T being rivetted to the bottom of said first section and the vertical portion of the T functioning as an ice skate blade.

3. A sporting knee boot made of semi-rigid plastic material and having a contoured shell adapted to engulf the user's knee and part of the user's thigh and calf, comprising a first section having a curved bottom portion and upwardly extending side portions, said first section being adapted to receive and support the knee and the upper one third to one half of the user's calf wherein the front of the user's thigh extends through a forward opening of said first section and the user's lower calf extends through a rearward opening of said first section, a second section having a pair of side portions extending from the user's knee to a distance of one third to one half of the height of the user's thigh, said side portions of said second section overlapping said side portions of said first section and being pivotally connected thereto by hinge means, said second section having a curved band for engaging the front of the user's thigh, the ends of said band being connected to the front edges of said side portions of said second section, a spring connected between said first section and said second section wherein said second section is biased for rotational movement in the direction of the user's calf, an adjustable strap secured to the side portions of said second section for engaging the rear of the user's thigh, at least one adjustable strap secured to the side portions of said first section for engaging the rear of the user's calf, and a wheel assembly having an axle, a pair of wheels, a frame, and a contoured plate for securing the wheel assembly to the bottom of said first section.

* * * * *